United States Patent [19]

Silver

[11] 4,349,970

[45] Sep. 21, 1982

[54] SHOE

[76] Inventor: Samuel Silver, 13953 SW. 66th St., Apt. 307, Miami, Fla. 33183

[21] Appl. No.: 180,604

[22] Filed: Aug. 25, 1980

[51] Int. Cl.[3] ..... A43B 7/06; A43B 13/28; A43B 13/12

[52] U.S. Cl. ..... 36/3 B; 36/12; 36/30 R

[58] Field of Search ..... 36/3 R, 3 A, 3 B, 11.5, 36/12, 23, 25 R, 30 R, 43, 44

[56] References Cited

U.S. PATENT DOCUMENTS

| | | | |
|---|---|---|---|
| 2,407,556 | 9/1946 | Kleven | 36/12 |
| 2,538,170 | 1/1951 | Stritter | 36/11.5 |
| 3,791,051 | 2/1974 | Kamimura | 36/3 B |
| 4,297,796 | 11/1981 | Stirtz et al. | 36/30 R |

*Primary Examiner*—Patrick D. Lawson

*Attorney, Agent, or Firm*—Berger & Palmer

[57] ABSTRACT

A shoe upper easily connected by a connecting device to a lower member or mid sole having a lattice structure. The shoe also includes additional connecting devices to releasably connect the heel to the mid sole and upper. The outer sole is connected to the mid sole by glue or double-sided tape. The mid sole is made from a synthetic material which allows breathing through the apertures in the lattice structure. Also, the outer sole and heel are removeably attached to the mid sole and upper to provide a shoe that may be resoled and reheeled inexpensively using ordinary tools.

10 Claims, 5 Drawing Figures

SHOE

BACKGROUND OF THE INVENTION

Typical shoe manufacturing involves the making of shoe uppers, preparing soles and heels and joining them together. The lasting operation, attaching the upper to the soles requires special skills, equipment and machinery. The present invention involves an inexpensive shoe structure and method of attaching a mid sole structure to the upper. Making this new and improved shoe requires no special equipment and no machinery. Semi-skilled and nonskilled labor may be used. The new and improved method allows the sole and heel to be removably attached to the plastic mid sole and upper. Thus, the present invention results in a shoe that is easier to assemble and allows the upper and mid sole to be reused on any type of shoe initially made on this type construction. The sole and heel are easily removed and replaced by use of a hand tool.

BRIEF SUMMARY OF THE INVENTION

The present invention relates to a shoe construction and method of making and a method of easily replacing the sole and heel. The shoe includes an upper, a lower member or mid sole, connecting means, lower sole and heel. The upper is secured by connecting means to a lattice mid sole made from a synthetic material such as a flexible durable plastic. The lattice structure of the plastic mid sole allows a user's foot to breathe downwardly as it normally breathes through the upper. The mid sole covers the entire bottom of the upper in a single piece construction.

The connecting means may take a plurality of forms, such as wire connectors positioned on the inner surface of the bottom portion of the upper. The wire ends are then threaded through prepunched holes in the bottom portion of the upper and passed through the preformed holes in the mid sole. Wire ends are then twisted together to pull tight and fix the mid sole to the upper. The twisted ends may then be placed in a preformed groove in the bottom of the mid sole. The groove is placed in the mid sole adjacent the mid sole edge on the bottom face of the mid sole. A plurality of holes may be located in each groove.

A preferred connecting means is in the general shape of a U-shaped flat member having a plurality of female mating connectors positioned in the member. The U-shaped flat member is placed over the bottom portion of the upper and the female connectors are aligned with the holes in the bottom portion of the upper. Then the mid sole is placed below the upper and U-shaped flat member and the mid sole holes are aligned with the holes in the upper and the female connectors in the U-shaped flat member. The male mating connectors are then secured to the female mating connectors in the U-shaped flat member to secure the upper to the mid sole.

The holes are placed in the bottom portion of the prefabricator upper by placing the upper over a last having holes that match the molded holes in the mid sole and the position of the female mating connectors in the U-shaped flat member. The position of the female mating connectors match the position of the molded holes in the mid sole.

The heel may be attached to the rear lower surface of the mid sole by a releasable means such as screws. The screws are inserted through the heel portion of the upper and the heel portion of the mid sole into the heel. The releasable screws are used so that the heel may be removed easily with a conventional screwdriver.

An outer sole is made from conventional sole material and is glued or connected by a double sided tape or attached by other means to the bottom of the mid sole. The edge pattern of the outer sole is constructed to conform to that of the mid sole. The plastic lattice structure allows a worn outer sole to be stripped away and replaced by using a knife or other hand tool when a double-sided tape is used. The outer sole may be grooved adjacent the perimeter.

The advantage of the above described construction is that it allows the upper and the mid sole to be easily attached and allows the outer sole and heel to be easily removed and replaced with ordinary hand tools. The method of making the shoe is less costly than prior shoe construction methods yet of very high quality. Because the outer sole and heel are easily removable and replaceable, for a greater length of time and more economically.

It is an object of this invention to provide a mid sole easily attachable to an upper.

It is another object of this invention to provide an easily replaceable sole and heel.

It is another object of this invention to provide a mid sole of lattice construction at lower cost and providing greater breathing of user's foot.

In accordance with these and other objects which will be apparent hereinafter, the instant invention will now be described with particular reference to the accompanying drawings.

DESCRIPTION OF THE PREFERRED EMBODIMENTS

Figure 1:
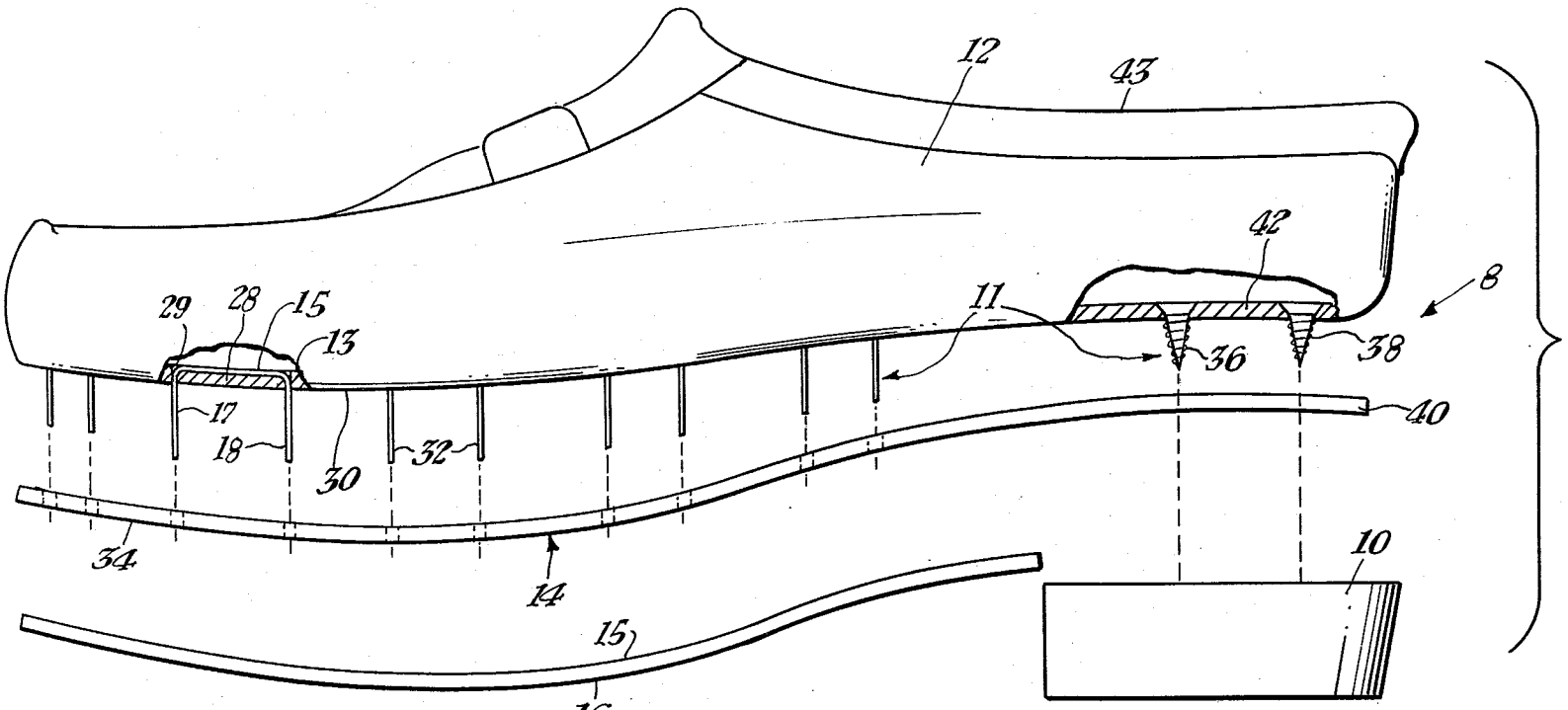
FIG. 1 is an exploded view of the shoe.
Figure 2:
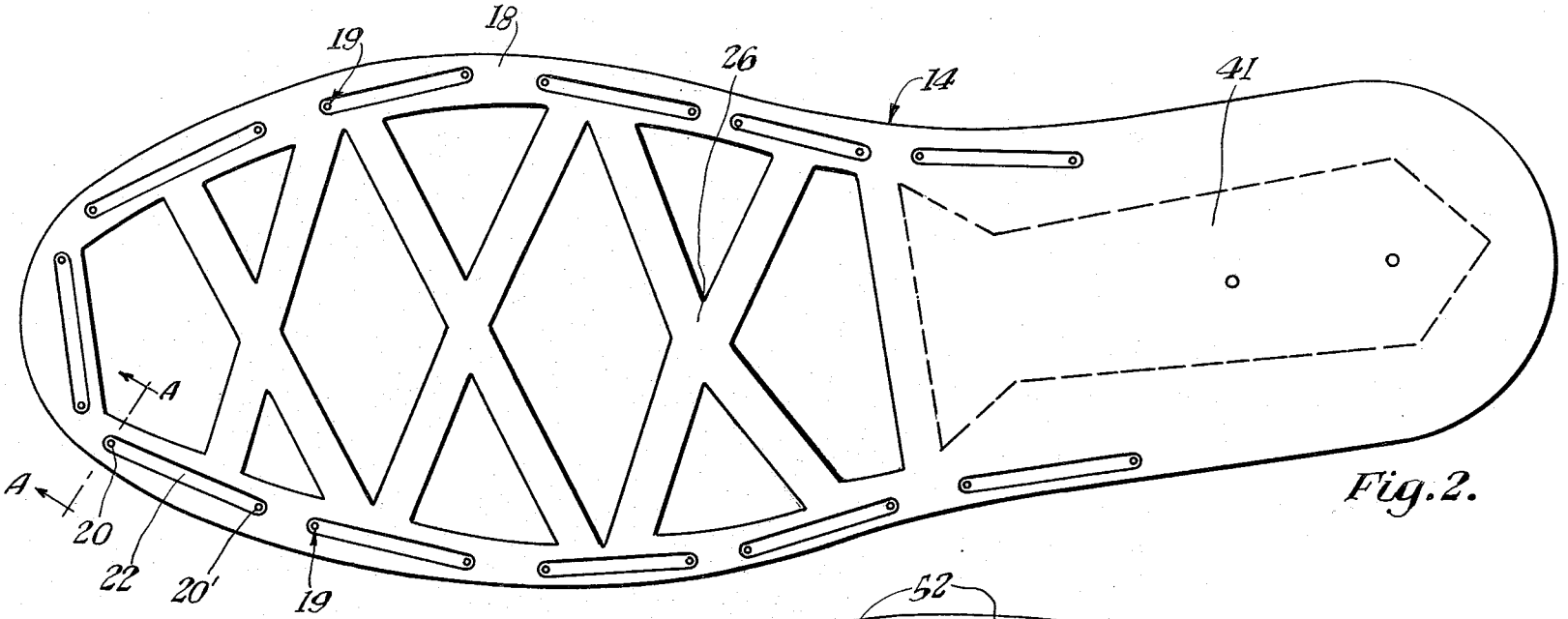
FIG. 2 is a bottom view of the mid sole portion of a right foot of the invention shown in FIG. 1.

This invention relates to a new and improved shoe 8 shown in FIGS. 1 and 2 with an upper 12 which is easily attachable to a lower member or inner sole 14 having a lattice structure shown in FIG. 2 by numeral 26. The shoe 8 also includes connecting devices generally designated by numeral 11, a heel 10 connectable to the mid sole 14 at 40, and an outer sole 16 connectable to the mid sole 14 at 34 by glue 15 or a double sided tape. The mid sole 14 is made from a synthetic plastic material which allows breathing through the apertures in the lattice structure 26. The mid sole 14 is attached to the upper by connecting devices. The connecting devices may be wires as shown in FIG. 1 or the preferred U-shaped flat member 50 shown in FIG. 4. The shoe structure allows the outer sole, 16 and heel 10 to be easily replaced.

The mid sole or lower member 14 is made from a synthetic material such as a flexible durable plastic. The lattice structure of the plastic mid sole 14 covers the entire bottom of the upper 12 in a single piece construction. The outer sole 16 is constructed with the same outer perimeter pattern as the inner sole 14.

Figure 3:
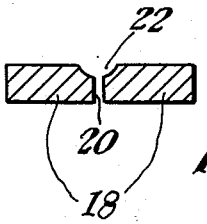
FIG. 3 is a cross-section view taken along lines A—A in FIG. 2 and looking in the direction of the arrows.

The connecting devices or connecting means used to connect the mid sole 14 to the upper 12 in FIG. 1 are wires 15 that are positioned on the mid surface 13 of the bottom portion 28 of the upper 12. The wire ends 17 and 18 are then threaded through prepunched holes 29 in the bottom portion 28 of the upper 12 and through the preformed holes 19 are in the mid sole 14. Wire ends 17 and 18 are then twisted together to tighten and fix the mid sole 14 to the upper 12. The twisted ends (not shown) may then be placed in a groove 22 preformed in the bottom of the mid sole 14 as shown in FIGS. 2 and 3. Grooves similar to groove 22 may be placed in the rim 18 of the mid sole 14 adjacent the mid sole edge on the bottom face of the mid sole 14. Within each groove 22 is a plurality of holes 20 and 20' through which the wire ends protrude to attach the upper to the mid sole.

Figure 4:
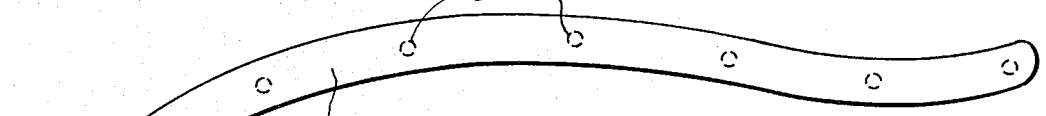
FIG. 4 is a top view of a U-shaped connector member for a left foot.
Figure 4:
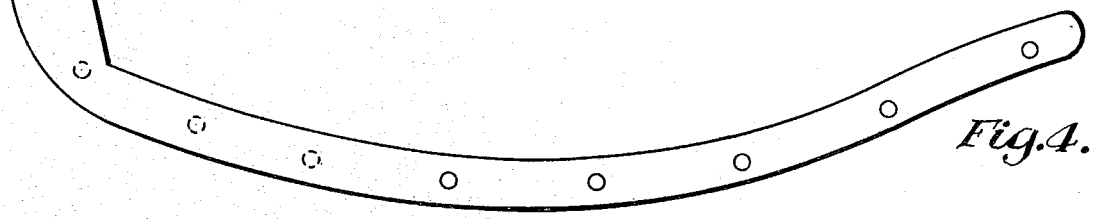
Figure 5:
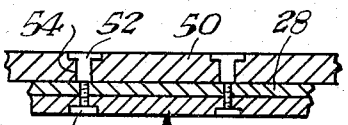
FIG. 5 is a partial cross-sectional side view of a portion of the upper, U-shaped connector and the mid sole.

A second and preferred connecting means is shown in FIGS. 4 and 5, the generally U-shaped flat member 50 is placed over the bottom portion 28 of the upper 12 and the female connectors 52 are aligned with the holes 29 in the bottom portion of the upper 12. Then the upper 12 and U-shaped flat member 50 are connected to the mid sole 14 by screwing male connectors 56 into the female connectors 52. The connector means holds the upper portion 28 and the mid sole 14 together. The U-shaped flat member 50 may be constructed with holes 54 into which the female connectors are placed or the female connectors may be placed in the U-shaped member during the molding process. Other types of connectors may be used, such as snap connectors.

It should be noted that the holes 29 are placed in the bottom portion 28 of the upper 12 by punching the holes with a hand tool.

The shoe upper 12 may be constructed from conventional shoe material such as leather and is of any conventional design. The shoe upper may be a high quality material that has received high quality workmanship. The present invention does not preclude any particular shoe style.

Heel 10 shown in FIG. 1 may be attached to the lower surface of the mid sole 14 by other connecting means. A releasable means such as screws 36 and 38 may be inserted through the lower heel portion 42 of the upper 12 by way of the opening 43, through the mid sole heel portion 40 and into heel 10. The releasable screw is used so that the heel may be removed easily with a screwdriver. The screws 36 and 38 pass through in lower portion 42 of the upper to secure the upper to the mid sole. The screws all secure the steel shank 41 in place.

The outer sole 16 is made from conventional sole material. The outer sole is glued or attached by other well known means to the bottom of the mid sole. Double sided tape may be used. The outer sole may be easily stripped away by working a knife between the outer sole and the mid sole. After removal, glue or a double sided tape may be placed among the perimeter of member or rim 18 on the lower surfaces of the mid sole and a new sole placed over and connected to the glue or tape.

It should be noted that the outer sole may be grooved adjacent the perimeter of the upper side. This allows the double-sided tape to be placed therein. This allows the tape to be used without increasing the thickness of the dimension of the inner sole and outer sole.

The mid sole 14 includes a steel shank of the dimensions shown in FIG. 4 at 41. A foot cushion may be placed inside the upper 12 to cover the wires 15 or U-shaped member 50 to protect the foot from the connecting devices.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A shoe comprising:

an upper, a lower member, an outer sole, and a heel; connecting means for securing said upper to said lower member, said heel and said outer sole;

said upper has a plurality of openings on the bottom of said upper for connecting said upper to said lower member;

said lower member constructed of at least partially synthetic material having a means for allowing the foot of a user in said upper to also breathe downward through said lower member, said lower member having a plurality of openings for connecting said upper to said lower member;

said connecting means including a first connecting means, a second connecting means and a third connecting means;

said first connecting means for passing through the openings in said lower member and the openings in said upper to fix said lower member to said upper;

said second connecting means for connecting said heel to said upper;

said third connecting means for connecting said outer sole to said lower member.

2. A shoe as set forth in claim 1, wherein;

said second connecting means for releasably connecting said heel to said upper;

said third connecting means for releasably connecting outer sole to said lower member.

3. A shoe as set forth in claim 1, wherein;

said lower member is a mid sole of lattice structure of a plastic material.

4. A shoe as set forth in claim 3, wherein;

said openings in said mid sole are adjacent the perimeter of said mid sole;

said openings in said upper are in said bottom of said upper;

said openings in said lower member and said openings in said upper are located in matching positions, said first connecting means pass through said opening in said lower member and said upper.

5. A shoe as set forth in claim 4, wherein;

said first connecting means includes a generally U-shaped member; and a plurality of matable connector members.

6. A shoe as set forth in claim 4, wherein;

said first connecting means includes a plurality of wire connectors.

7. A shoe as set forth in claim 6, wherein;

said lower member includes a plurality of grooves with a pair of apertures in spaced relation in each groove for placement of the connected ends of said wire connectors.

8. A shoe as set forth in claim 7, wherein;

said second connecting means for connecting a heel to said lower member includes at least one screw.

9. A sole as set forth in claim 5, wherein;

said second connecting means for connecting a heel to said lower member includes at least one screw.

10. A shoe mid sole comprising;

said mid sole constructed of at least partially synthetic material having a means for allowing the foot of a user in said upper to also breathe downward through said mid sole, said mid sole having a plurality of openings for connecting an upper to said mid sole;

said mid sole has a forward lattice structure;

said openings in said mid sole are adjacent the perimeter of said mid sole.

* * * * *